US012760899B2

(12) United States Patent
Dimitrijevic

(10) Patent No.: US 12,760,899 B2
(45) Date of Patent: Oct. 13, 2026

(54) VENT ASSEMBLY FOR OUTDOOR COMBUSTION FACILITY AND ASSOCIATED METHOD

(71) Applicant: ENGINEERED PRODUCT SUPPLY, LLC, Branchville, NJ (US)

(72) Inventor: Petar Dimitrijevic, Montville, NJ (US)

(73) Assignee: Engineered Product Supply, LLC, Branchville, NJ (US)

( * ) Notice: Subject to any disclaimer, the term of this patent is extended or adjusted under 35 U.S.C. 154(b) by 376 days.

(21) Appl. No.: 18/647,291

(22) Filed: Apr. 26, 2024

(65) Prior Publication Data

US 2024/0360999 A1 Oct. 31, 2024

Related U.S. Application Data

(60) Provisional application No. 63/462,817, filed on Apr. 28, 2023.

(51) Int. Cl.
*F24B 1/192* (2006.01)

(52) U.S. Cl.
CPC ..... *F24B 1/192* (2013.01)

(58) Field of Classification Search
CPC .. F24B 1/192; F24B 1/191; A47G 5/04; F24F 2007/0025; F24F 13/084; E04B 1/7076; E04B 7/02; E04D 13/1475; E04F 17/026; F23L 17/02; F23J 2213/50
USPC ..... 126/500, 515
See application file for complete search history.

(56) References Cited

U.S. PATENT DOCUMENTS 11,885,500 B1 * 1/2024 Ressler ..... F24B 3/00
2012/0210994 A1 * 8/2012 Gulotta ..... F24C 3/022 126/39 R

OTHER PUBLICATIONS

Screen capture from YouTube video entitled "Quick_E Classic Vents", uploaded on May 30, 2019 by Pave Tool Innovators. Retrieved on Jun. 1, 2026 from https://www.youtube.com/watch?v=NpJHan7URWY. (Year: 2019).*
Screen capture from YouTube video entitled "Empire Distributing—Warming Trends Ventilation", uploaded on Jan. 31, 2020 by Empire Distributing. Retrieved on Jun. 5, 2026 from https://www.youtube.com/watch?v=C6lqtecfCZQ (Year: 2020).*
The Outdoor Greatroom Company 2022 Catalog, dated (on p. 75) Nov. 2021. Retrieved from: https://www.francisoil.com/images/products/Catalogs/OGC-Outdoor-Greatroom-2022-Catalog.pdf on Jun. 6, 2026 (Year: 2021).*
Vent specifications by Hearth Products Controls Co., dated Aug. 15, 2018. Retrieved from: https://hpcfire.com/wp-content/product-documents/Outdoor%20Products%20Drawings/Other/Accessories/Enclosure%20Vents.pdf on Jun. 5, 2026 (Year: 2018).*

* cited by examiner

*Primary Examiner* — Allen R. B. Schult
*Assistant Examiner* — Amy E Carter
(74) *Attorney, Agent, or Firm* — Wendi E. Uzar

(57) ABSTRACT

A vent assembly for a firepit or other outdoor combustion facility includes a face member and a support member. The face member has a perimeter and a thickness in a direction orthogonal to the perimeter. The support member has a predetermined resilience allowing limited elastic deformation of the support member upon application of manual compressive force to the support member. Connectors on the face member and the support member cooperate to lock the face member and the support member to one another.

16 Claims, 9 Drawing Sheets

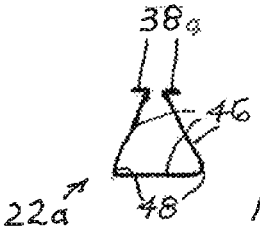
FIG. 7A
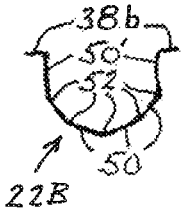
FIG. 7B
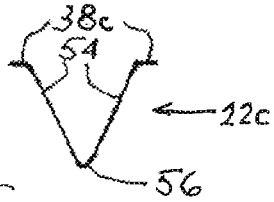
FIG. 7C
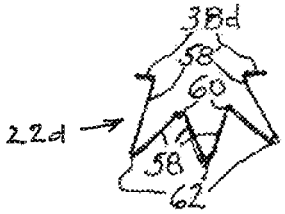
FIG. 7D
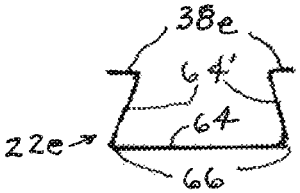
FIG. 7E
FIG. 8B
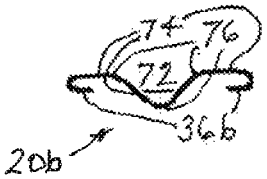
FIG. 8A
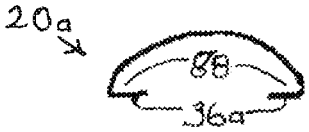
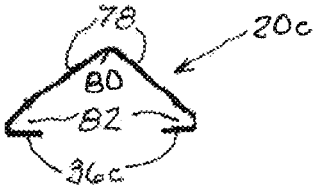
FIG. 8C
FIG. 8D
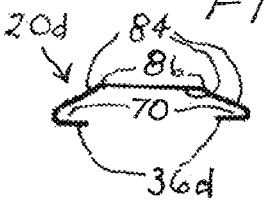

VENT ASSEMBLY FOR OUTDOOR COMBUSTION FACILITY AND ASSOCIATED METHOD

CROSS-REFERENCE TO RELATED APPLICATIONS

This is the non-provisional patent application of provisional patent application Ser. No. 63/462,817 which was filed on Apr. 28, 2023, which is hereby incorporated by reference.

BACKGROUND OF THE INVENTION

This invention relates to outdoor combustion facilities including firepits, chimineas, fireplaces and grills.

While building recreational fires has been around for millennia, modern times have shown a progression towards more standardized means of housing and displaying recreational fires. One such method gaining popularity is a stone firepit made of many regularly shaped concrete blocks. These stone firepits are usually comprised of several rows, more commonly known as courses, of blocks stacked to form a circular or rectangular wall around a central burn area. They have become a major element of many residential and commercial projects in the hardscaping industry.

These stone firepits are most commonly one of two configurations: wood-burning or gas-burning. Wood-burning firepits use solid wood fuel, while gas burning firepits use fluid, combustible fuel; most often liquid propane (LP) or natural gas (NG). In any case, both types of firepit require airflow and stand to benefit from adding it, albeit for different reasons.

In the case of a wood-burning firepit, the solid fuel requires oxygenated air at the point of combustion to sustain combustion. As a general rule, the more oxygen and the more directly it is delivered to the burning fuel source, the more efficient the fire. Firepit users most often favor fires with the following characteristics: less smoke, more heat, and faster ignition. All of these characteristics can be improved with the addition of air intake near the bottom of the firepit, which provides fresh, oxygenated air directly to the fuel source.

In a wood-burning firepit, without an air intake at the bottom of the firepit, oxygenated air can still make its way to the fuel source; however, the path it must take is opposite the upward flow of gases produced by convection currents of a burning fire. As a result of these opposing flows, less oxygenated air reaches the fuel, and thus the efficiency of the fire suffers. In contrast, when an air intake is introduced at the bottom, it works cooperatively with the upward moving convection currents, enabling more efficient, unidirectional airflow. In this case, the air path begins outside the firepit, travels through the intake to the fuel source, and then the oxygen-depleted air will continue upward, leaving the firepit. This process is driven by the low pressure zone of the fire, which pulls in more fresh air through the intake(s) below in a self-sustaining cycle.

In the case of a gas-burning firepit, proper venting of the inside of the firepit is critical for safety. The configuration of a gas firepit usually has a burner mounted to a mounting plate with gas plumbing lines (and potentially the fuel source) below. If there are any leaks in the gas plumbing or containers, the combustible gas can build up beneath the mounting plate and create a dangerous situation where one spark could ignite the trapped gas, resulting in an explosion. For this reason, it is essential to have an interface that allows the air outside and inside the firepit to exchange, so any combustible gases may dissipate before building up to an unsafe level.

As described, both types of firepit have a need for outside air to flow in and/or out of the middle of the firepit. In both cases, an effective way to achieve this is by introducing one or more holes around the firepit block wall that allow passage of air into and/or out of the center of the firepit. In a stone firepit, one simple way to add these holes is to remove one or more blocks around the perimeter of the firepit. While this solution is straightforward, it introduces several new problems: first, the hole(s) can aesthetically detract from the firepit; second, the firepit may lose some structural support where the blocks are removed; third, the holes introduce a path for burning materials to exit the pit in an unexpected area, creating a safety hazard; and finally, the holes allow debris and other objects, including human extremities, to enter the firepit, adding another safety hazard. These issues can be, at least partially, resolved with the introduction of a firepit vent/intake.

Current industry offerings for vents/intakes have different shortcomings depending on the style. There are two primary styles of vent/intake:

The first style is a flat plate with openings that is mounted onto the side of the firepit with fasteners, such as concrete screws. This solution resolves the aesthetic issue and restricts some burning material and larger objects from passing in and out of the pits, but provides little support for the blocks above the removed block. Often, these vents/intakes are not specified to fit any particular firepit block and require cutting and drilling of the block, in addition to mounting hardware. Installers of firepits and vents/intakes prefer to minimize, if not eliminate, customization, drilling, cutting, hardware, etc. For this reason, while the first style tends to be less expensive, it also tends to be disliked by installers.

The second style is a more three-dimensional style vent/intake that occupies the space of a removed block in the wall of the firepit. These types of vents/intakes usually resemble a skeleton of the block they replaced. This style is usually designed to provide support to the blocks above in cases where those blocks may sag down, while allowing air to pass in and out of the firepit through the vent.

The second style is easier to install, as it is typically designed for specific sizes of firepit blocks and fits with little extra effort on the part of the installers; however, an issue with the second style is they cost more to manufacture and often take up much more space in shipping and storage, leading to greater costs.

In most cases, the cost of a few vents/intakes for a stone firepit is substantial compared to the cost of the firepit blocks themselves, causing many firepit buyers to opt out of using vents/intakes. Omitting vents/intakes in a firepit can diminish enjoyment for those with wood-burning firepits and negatively impacts the safety of those with gas-burning firepits.

All preceding discussion of vents in relation to firepits applies similarly to other outdoor combustion facilities, including chimineas, fireplaces and grills.

OBJECT OF THE INVENTION

It is an object of the present invention to provide a more user-friendly, cost-effective, and efficiently stored vent/intake apparatus for outdoor combustion facilities.

This and other objects of the invention will be apparent from the drawings and descriptions herein. Although every object of the invention is attained in at least one embodiment of the invention, there is not necessarily any embodiment which attains all of the objects of the invention.

SUMMARY OF THE INVENTION

A vent assembly for deployment in an airflow hole in a wall of an outdoor combustion facility comprises, in accordance with the invention, a face member and a support member. The face member has a perimeter and a thickness in a direction orthogonal to the perimeter. The support member has a predetermined resilience allowing limited elastic deformation of the support member upon application of manual compressive force to the support member.

The support member has a first terminal portion along one end and a second terminal portion along an opposite end. The first terminal portion and the second terminal portion are disposed at a first distance from one another in a relaxed or unstressed configuration of the support member.

First connectors are provided on the face member proximate opposing ends thereof, more particularly at or proximate opposing edges of the face member. The first connectors are thus spaced from one another along a length dimension of the face member. Where the face member overlaps an outer surface of an airflow or vent hole in a wall of a combustion facility, the first connectors are spaced from the edges of the face member to allow the periphery of the face member to engage an outer surface of the wall around the airflow or vent hole.

Second connectors are provided on the support member at the first terminal portion and at the second terminal portion. The second connectors are configured to cooperate with respective ones of the first connectors to attach the support member to the face member.

The predetermined resilience of the support member is effective to exert a spreading force on the support member to press the first terminal portion and the second terminal portion away from one another and lock the second connectors to the respective ones of the first connectors. In a locked configuration of the face member and the support member, the first terminal portion and the second terminal portion of the support member are disposed at a second distance from one another, where the second distance is less than the first distance.

A vent assembly pursuant to the present invention facilitates transport by reducing space requirements. In unassembled states, support members of preferred configurations may nest together, and the same may apply to face members. The support members may have a near-planar, for instance, a moderately bowed, configuration for transport, thus reducing space requirements more. Any incremental saving in space can add up to significant savings in shipping costs for bulk quantities of the parts.

Pursuant to a further feature of the present invention, the support member has a lower edge, engageable with a horizontal support surface. The support member evinces, in the locked configuration of the face member and the support member, an at least partially arcuate profile in a horizontal cross-section taken parallel to the lower edge. Thus, in at least some embodiments of the invention, the support member is bent or otherwise formed into an arched or arcuate form in the locking configuration of the face member and the support member. Concomitantly, the support member is concave on a side facing the face member in the assembled or locked configuration of the assembly.

The support member preferably has, at the terminal portions, linear edges that are typically oriented vertically in the airflow or vent hole upon deployment of the assembled or locked configuration of the vent assembly. The support member may be formed with one or more undulations, or bends, about axes parallel to the linear edges of the terminal portions. Thus, the undulations or bends extend in a direction perpendicular to the lower edge of the support member. The bends may be sharp, with the support member having two or more planar sections bordered by at least one bend. Such a planar section may extend between an arcuate or bent portion of the support member on one side and a terminal portion or vertical edge of the support member on another side.

In accordance with another feature of the present invention, the first connectors and the second connectors are each either a projection or a receptacle. The projections may take the form of flanges or ribs, while the receptacles take the form of channels or slots.

Pursuant to a further feature of the present invention, at least a portion of the perimeter of the face member has the pre-established thickness. That perimetral portion is typically linear and includes a linear edge. However, ornamental design features may be incorporated into the face plate such as edges that are arcuate, for instance, outwardly bowed.

Where the face member has a rectangular perimeter, with linear edges particularly along the sides of the member, the first terminal portion and the second terminal portion of the support plate are preferably linear as well. The projections and receptacles are elongate features in such an embodiment of the present vent assembly.

Alternatively, pursuant to a different feature of the present invention, the perimeter of the face member and/or the support member is broken or interrupted by indentations or recesses along the perimeter. The indentations or recesses serve as airflow openings. Alternatively or additionally, the face member and/or the support member may be provided with one or more airflow apertures in the middle of the member, between opposing ends or terminal portions thereof. The apertures may have virtually any shape and distribution, although rounded shapes and even distributions are preferred.

A method for installing a vent assembly in an outdoor combustion facility comprises, in accordance with the present invention, providing a combustion-space wall, a face plate, and a support member. The wall has at least one through-hole (or recess, in the case of partial construction) in a lower portion of the wall. The support member is made of elastically deformable material and, in the assembled or locked configuration of the vent assembly, has dimensions smaller than the transverse dimensions (height, width) of the through-hole or recess. Pursuant to the present invention, the method further comprises exerting a compressive force on the support member to thereby press end portions of the support member towards one another. While the end portions are disposed at a reduced distance from one another owing to the pressing of the end portions towards one another, one manipulates the face plate and/or the support member to position projections on one of the face plate and the support member in proximity with respective receiving formations on the other of the face plate and the support member. Thereafter the compressive force on the support member is released to lodge the projections in respective ones of the receiving formations and thereby attach the face member and the support member to one another to form an assembled configuration of the face member and the support member. The support member has a predetermined resilience or elasticity effective to exert a spreading force on the support member to press the end portions of the support member away from one another and lock the projections to the respective ones of the receiving formations. The method then entails manipulating the assembled configuration to dispose the support member in the through-hole or recess and to dispose the face plate in proximity to an outer surface of the wall.

The face member of the vent assembly may be positioned even with the outer surface of the containment wall, or may protrude from the through-hole slightly so that the perimeter of the face member lies along the outer surface of the wall. Alternatively, in preferred embodiments, the vent assembly is installed so that the face plate is recessed inwardly with respect to the outer face of the containment wall of the combustion facility. The recessed or inwardly staggered disposition of the vent assembly serves an aesthetic function of hiding the connector elements from visual observation when one looks from above or below. This pertains to most round firepits (the most common type) because most firepit stones have flat outer faces. Only in round firepits made of stone with convexly curved outer faces can one install a vent assembly with the face member flush with the outer surface of the containment wall while also hiding the connector elements. In such cases, the front face of the vent is best curved, that is, outwardly convex, so to be truly flush.

The present method contemplates that the vent assembly may be deployed during construction of a combustion facility, that is, prior to completion of the enclosure or wall. In that event, one or more airflow holes or openings may still be in the form of gaps or recesses, rather than through-holes.

The connectors on the face member and the support member may be arranged to provide for reversibility of the orientations of the face member and support member with respect to each other. Accordingly, the support member and face member may be rotated 180 degrees (along a central axis running perpendicular to the front face of the face member) with respect to each other. This further simplifies assembly for end users and installers.

BRIEF DESCRIPTION OF DRAWINGS

FIGS. 7A-7E are top plan views of several alternative versions of a support member of a firepit vent assembly in accordance with the present invention.

FIGS. 8A-8D are top plan views of several alternative versions of a face plate of a firepit vent assembly in accordance with the present invention.

DETAILED DESCRIPTION OF THE INVENTION

Figure 1:
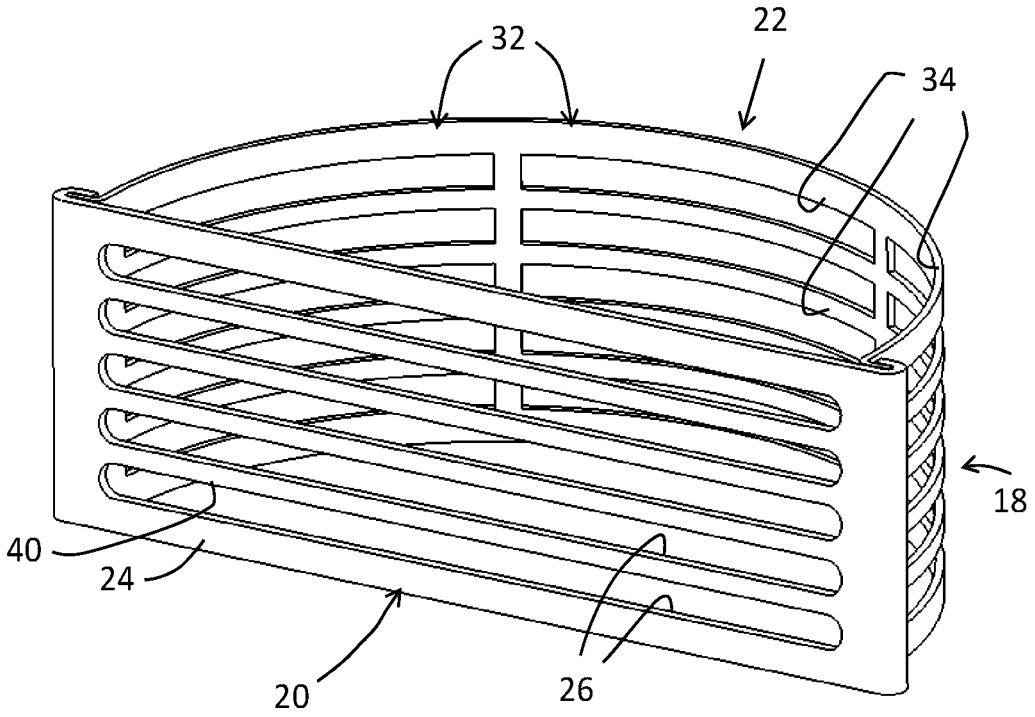
FIG. 1 is a front, left side, and top perspective view of a firepit vent assembly in accordance with the present invention, in an assembled or locked deployment configuration.

A "combustion facility" or "outdoor combustion facility" denotes herein a partially enclosed space surrounded by a containment wall of stone, brick, or other refractory material and configured for burning wood, charcoal, natural gas, propane or other burnable material, generally for purposes of cooking, heating the ambient air, or entertainment. Outdoor combustion facilities include firepits, chimineas, grills, fireplaces, and outdoor pizza ovens.

The terms "vent" and "vent assembly" are used herein to designate a grating or networked article for insertion into an airflow hole of a combustion facility regardless of the direction of air or gas flow. Thus a vent assembly as that term is used herein may be used, for example, in a wood burning firepit or a gas burning firepit.

The term "face member" or "face plate" is used herein to denote an outward facing element, preferably but not necessarily planar, configured for placement at an airflow/gas-flow opening in a combustion-facility wall. On deployment, the face member may be positioned inside the opening, either at the outer surface of the combustion-facility wall or recessed within, or slightly outside the wall. In the latter case, the face member or plate may be larger than the airflow opening or port and thus overlap the wall of the combustion-facility on one or more sides of the airflow opening. A face member or plate may have inwardly and/or outwardly extending portions. A face member or plate typically has a plurality of apertures or perforations, which can have any shape and distribution so as to permit airflow while blocking the passage of objects such as sticks, rodents, human appendages and digits, etc.

The terms "assembled configuration" and "locked configuration" both refer to the arrangement of the face plate and support member wherein that they are connected to one another in a friction fit owing, for instance, to mating geometries of the connectors and the spring force exerted by the resilient material of the support member. The present invention contemplates mating connectors and a tension-enhanced friction attachment, where friction holds the two components together when the assembled vent is lifted by only one of the face member and the support member. Alternatively, the connectors may include shoulders or abutments that prevent a vertical sliding of the face member and the support member relative to one another. Other forms of quick-engagement connectors may be used, such as camming detents, dovetailing projections and recesses, pins and dual-width slots, snap-lock pins and holes, etc. Preferably, such alternative connector exhibit proper or even enhanced functionality under the spring force exerted by the deformed support member.

As illustrated in FIGS. 1-6, a firepit vent assembly 18 comprises a face member or plate 20 and a support member 22. Face plate 20 has a rectangular perimeter 24 and a uniform thickness in a direction orthogonal to a plane (not separately designated) defined by the perimeter. Face plate 20 is formed with a series of elongate horizontal airflow openings 26 that are geometrically identical and extend parallel to one another.

Support member 22 is made of a material such as metal alloy or thermoplastic that has a predetermined resilience allowing limited elastic deformation of the support member upon application of manual compressive force to the support member. Support member 22 has a first terminal portion 28 along one end and a second terminal portion 30 along an opposite end. Support member 22 is formed with three vertical arrays 32 of elongate horizontal airflow openings 34 that are geometrically identical and extend parallel to one another. Terminal portions 28 and 30 extend along opposite ends (not designated) of the arrays 32 of openings 34. Terminal portions 28 and 30 are disposed at a certain distance D1 from one another (FIG. 4) in a relaxed or unstressed configuration of the support member.

Connectors 36, 36' in the form of elongate bent-back flanges are provided on face plate 20 along opposing ends thereof. Flanges 36 define opposing edges of face plate 20. In an alternative design, the connectors may be spaced from the edges of face plate 20, whereby the face plate has a peripheral or border portion that may lie along the outer surface of a firepit containment wall.

Connectors 36, 36' are spaced from one another along a length dimension of the face plate, that is, along a horizontal dimension in a vent deployment orientation of the assembled assembly 18. Where face plate 20 is intended to overlap an outer surface of a firepit airflow or vent hole, connectors 36, 36' may be spaced from the edges of the face plate to allow a periphery of the face plate to engage an outer surface of the firepit wall around the airflow or vent hole.

Connectors 38, 38' are provided on support member 22 at the first terminal portion 28 and at the second terminal portion 30. Connectors 38, 38' are configured to cooperate with respective ones of face-plate connectors 36, 36' to attach support member 22 to face plate 20. Connectors 38, 38' take the form of elongate flanges oriented at right angles to the terminal portions 28 and 30 of support member 22.

In the embodiment illustrated in FIGS. 1-6, connectors 36, 36' form channels or slot-type receptacles that receive connectors 38, 38' in a mating fit.

The predetermined resilience of support member 22 is effective to exert a spreading force on the support member to press first terminal portion 28 and second terminal portion 30 away from one another and lock connectors 38, 38' to respective connectors 36, 36'. In a locked configuration of face plate 20 and support member 22, shown in FIGS. 1-3 and 5, first terminal portion 28 and second terminal portion 30 of support member 22 are disposed at a second distance D2 from one another, where distance D2 is less than distance D1.

Firepit vent assembly 18 facilitates transport by reducing space requirements. Multiple identical face plates 20 may be stacked together, and many support members 22 may likewise ship in stacked arrangements. Support members 22 may have a near-planar configuration for transport, thus reducing space requirements more.

Support member 22 has a lower edge 40, which is engageable with a horizontal support surface such as a floor 42 of a firepit vent hole or airflow aperture 44. Support member 22 evinces, in the locked configuration of face plate 20 and the support member, an at least partially arcuate profile in a horizontal cross-section taken parallel to lower edge 40. The locked or deployment profile of support member 22 may be semi-circular, parabolic, ellipsoidal, or hyperbolic. Other shapes of support member 22 are shown in FIGS. 7A-7E.

In the embodiment of FIGS. 1-6, support member 22 is bent into a continuously arched or smoothly arcuate form in the locked configuration of face plate 20 and the support member. Concomitantly, support member 22 is concave on a side facing face plate 20 in the assembled or locked configuration of the assembly 18.

In the embodiment of FIGS. 1-6, terminal portions 28 and 30 of support member 22 are elongate rectangular plate sections with linear edges at flanges 38 that are typically oriented vertically in firepit vent hole or airflow aperture 44 and perpendicularly to floor 42 upon deployment of the assembled or locked configuration of the vent assembly 18.

Connectors 36, 36' and 38, 38' may take other forms that enable a quick coupling and release of face plate 20 and support member 22. Alternative connectors thus include snap-locking formations, dove-tailing fingers, latches, etc. Channel connectors 36, 36' and flange connectors 38, 38' are preferable owing to simplicity of manufacture and use.

Support member 22 may be formed with one or more undulations, or bends, about axes parallel to the linear edges of terminal portions 28 and 30 at flanges 38. Thus, the undulations or bends extend in a direction perpendicular to lower edge 40 of the support member. The bends may be sharp, with support member 22 having two or more planar sections bordered by at least one bend. Such a planar section may extend between a bend on one side and a terminal portion or vertical edge of the support member on another side.

As depicted in FIG. 7A, a vent assembly support member 22*a* comprises three elongate plate sections 46 joined to each other along two sharp bends 48, with elongate flanges 38*a* oriented outwardly along free edges of two peripheral plate sections (not separately labeled). In an assembled configuration of a respective vent assembly, bends 48 extend in a direction perpendicular to a lower edge of support member 22*a*. In a deployed position of the respective assembled vent assembly, bends 48 are oriented vertically inside an airflow aperture or hole of a combustion facility.

As illustrated in FIG. 7B, a vent assembly support member 22*b* includes six elongate plate sections 50, 50' joined to each other along five sharp vertical bends 52, with flanges 38*b* extending outwardly along free edges of two peripheral plate sections 50'. In an assembled configuration of a respective combustion-facility vent assembly, bends 52 and plate sections 50 extend parallel to each other orthogonally to a lower edge of support member 22*b*.

As shown in FIG. 7C, a vent assembly support member 22*c* has two elongate plate sections 54 joined to each other along a single sharp vertical bend 56, with flanges 38*c* extending outwardly along free edges of the plate sections 54. In an assembled configuration of a respective combustion-facility vent assembly, bend 56 extends perpendicularly to a lower edge of support member 22*c*.

As presented in FIG. 7D, a vent assembly support member 22*d* includes six elongate plate sections 58, 58' joined to each other at two inner vertical bends 60 and three outer vertical bends 62, so that support member 22*d* has a corrugated or zig-zag configuration. Connector flanges 38*d* extend outwardly from vertical free edges of two peripheral plate sections 58'. In an assembled configuration of a combustion-facility vent assembly, bends 62 extend in a direction perpendicular to a lower edge (not visible) of support member 22*d*.

FIG. 7E illustrates a vent assembly support member 22*e* similar to support member 22*a* of FIG. 7A, with a variation in dimensions. Thus vent assembly support member 22*e* comprises three elongate plate sections 64, 64' joined to each other along two sharp vertical bends 66, with flanges 38*e* extending outwardly along free edges of two peripheral plate sections 64'. In an assembled configuration of a vent assembly, flanges 38*e*, plate sections 64, and bends 66 are all elongate parts that extend in a direction perpendicular to a lower edge of support member 22*e*, that is, vertically in a deployed position of the vent assembly.

Support member 22*a*-22*e* are all made of an elastic material the enables resilient deformation as discussed above with reference to support member 22.

Figure 2:
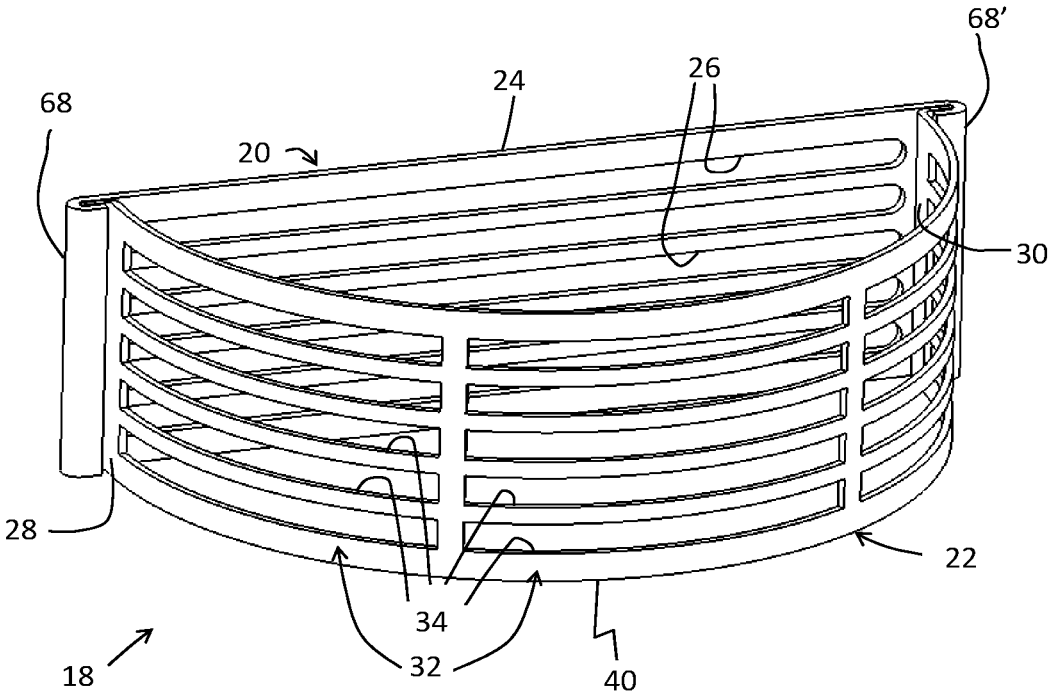
FIG. 2 is a rear, left side, and top perspective view of the assembled firepit vent assembly of FIG. 1.
Figure 3:
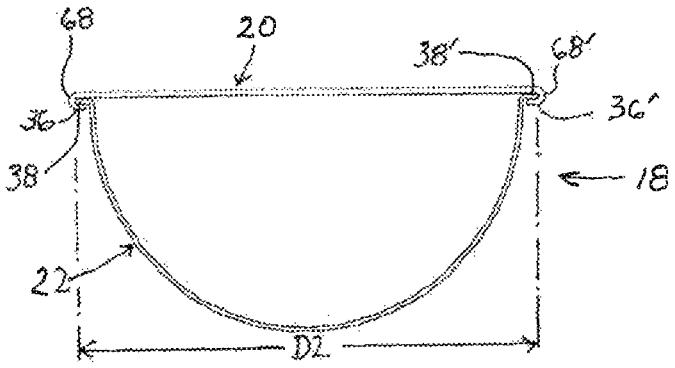
FIG. 3 is a top plan view of the assembled firepit vent assembly of FIGS. 1 and 2.
Figure 4:
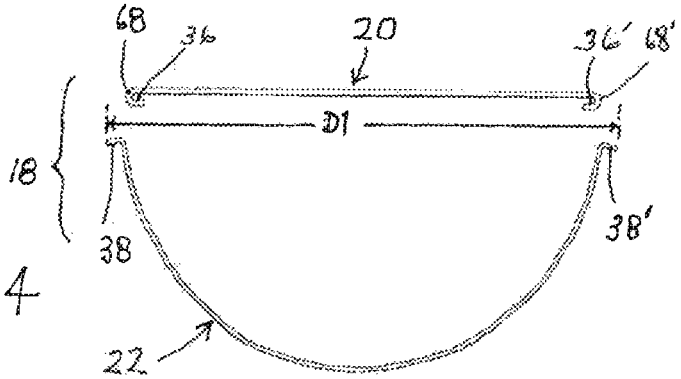
FIG. 4 is a top plan view, similar to FIG. 3, showing the firepit assembly in pre-assembly juxtaposition.
Figure 5:
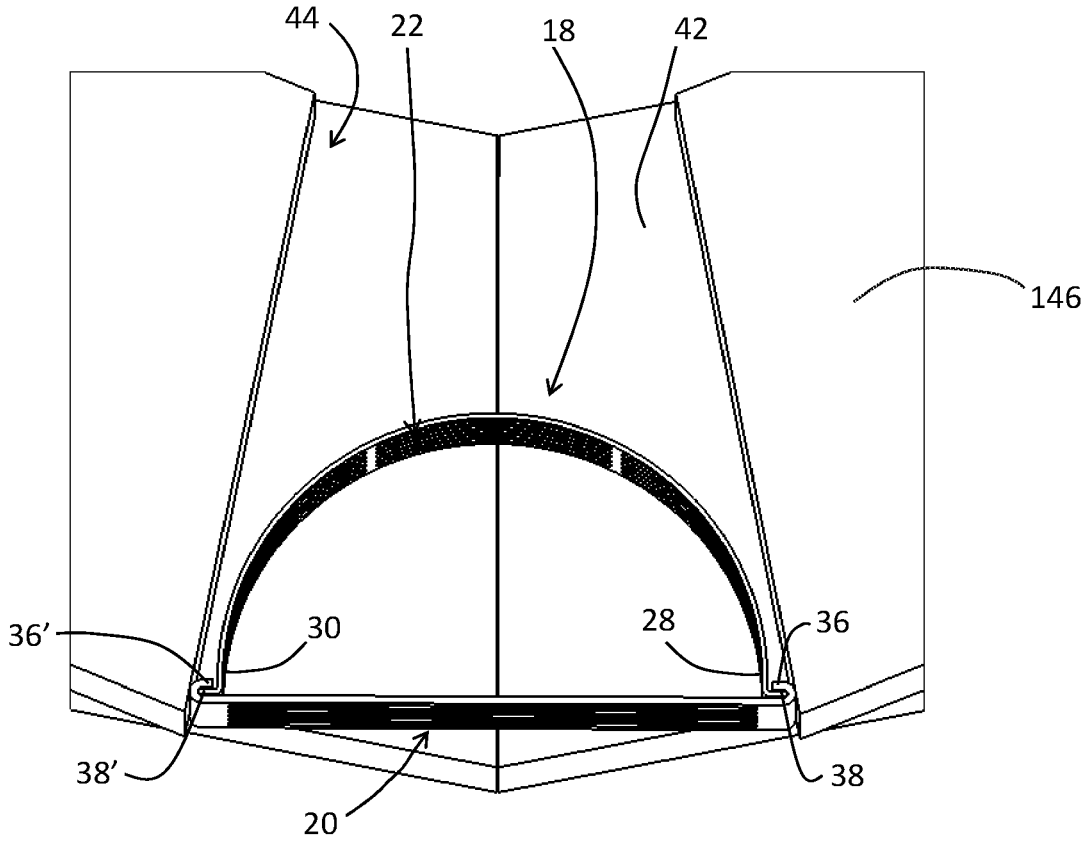
FIG. 5 is a horizontal sectional view of a firepit, showing the assembled firepit assembly of FIGS. 1-3 disposed in a deployment location inside an airflow opening or hole of the firepit.
Figure 6:
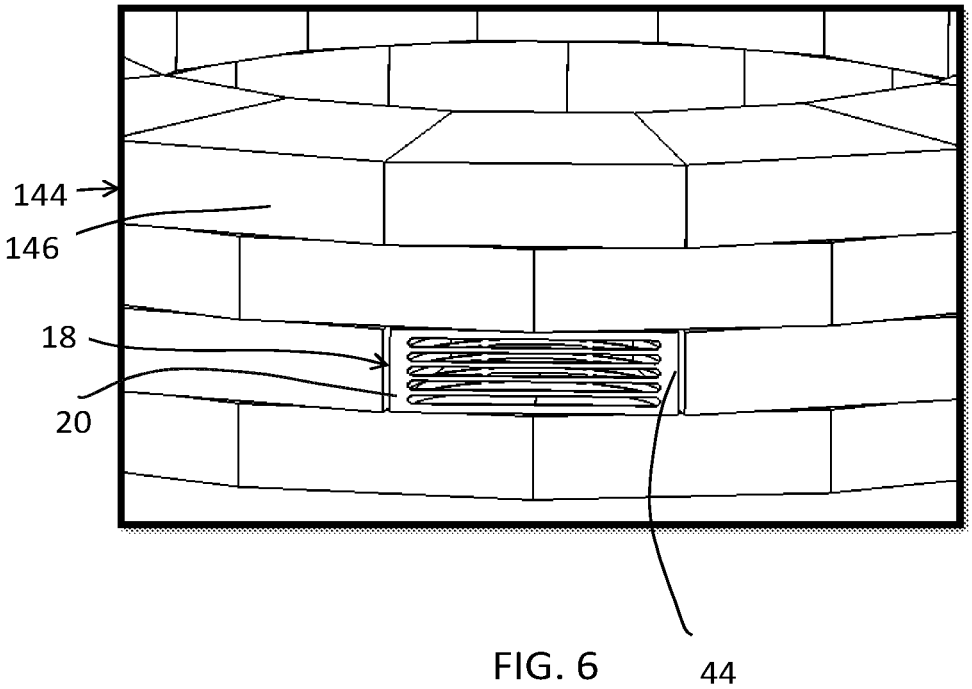
FIG. 6 is a lateral and top perspective view of the firepit of FIG. 5, showing the assembled firepit assembly of FIGS. 1-3 disposed inside the airflow opening or hole of the firepit.

At least a portion of the perimetral periphery of face place 20 has a certain, preselected thickness. That portion of the perimeter or periphery is typically linear and includes a linear edge, oriented vertically in the deployed positioning of the firepit vent assembly 18. However, ornamental design features may be incorporated into the face plate such as edges that are arcuate, for instance, outwardly bowed.

Where face plate 20 has a rectangular perimeter as shown in FIGS. 1 and 2, with linear lateral edges 68 and 68', terminal portions 28 and 30 of support member 22 are preferably linear as well. Concomitantly, connector flanges 38 extend linearly along the opposing vertically oriented ends of support member 22.

FIGS. 8A-8D depict alternative embodiments of face plate 20.

As shown in FIG. 8A, a face plate 20*a* of a firepit vent assembly is outwardly bowed and may assume an elongate arcuate form that is cylindrical, parabolic or elliptical in horizontal cross-section. Inwardly extending flanges 36*a* serve to define receptacles 88 for receiving mating flanges of a cooperating support member 22.

As represented in FIG. 8B, a face plate 20*b* of a firepit vent assembly manifests an inwardly extending V-shaped recess 72. Face plate 20*b* has four vertically extending platelet sections 74 joined to one another along three bends 76. Inwardly extending flanges 36*b* serve to define elongate receptacles or channels (not labeled) for receiving mating flanges of a cooperating support member 22.

As illustrated in FIG. 8C, a face plate 20*c* of a firepit vent assembly projects outwardly in a triangular fashion. Face plate 20*c* has two vertically extending platelet sections 78 joined to one another along a bend 80. Inwardly extending flanges 36*c* define elongate receptacles or channels 82 for receiving mating flanges of a cooperating support member 22.

As depicted in FIG. 8D, a face plate 20*d* of a firepit vent assembly projects outwardly and includes three vertically extending platelet sections 84 joined to one another along two vertical bends 86. Inwardly extending flanges 36*d* define elongate receptacles or channels 70 for receiving mating flanges of a cooperating support member 22.

Figure 9A:
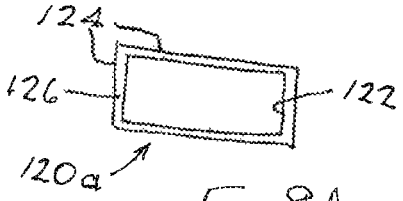
FIGS. 9A-9C are schematic front elevational views of alternative versions of a face plate of a firepit vent assembly in accordance with the present invention, showing different arrangements of airflow openings in the face plate.
Figure 9B:
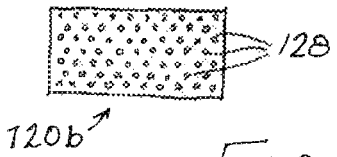
Figure 9C:
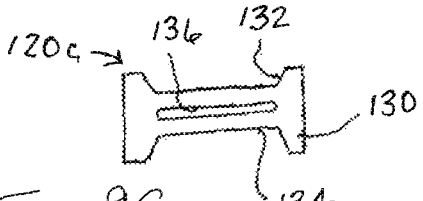

Both face plate 20 and support member 22 are provided with airflow apertures or openings. FIG. 9A shows a face plate 120*a* with a large rectangular opening 122 defining, together with outer edges 124 of plate 120*a*, a rectangular perimeter or periphery 126. FIG. 9B illustrates a face plate 120*b* with an array of small openings or apertures 128. FIG. 9C depicts a face plate 120*c* with a rectangular perimeter 130 broken or interrupted by indentations or recesses 132 and 134 along the perimeter and with an elongate central slot 136. (Likewise, support member 22 may be provided with indentations or recesses along its perimeter.) Opening 122, apertures 128, indentations or recesses 132 and 134, and slot 136 serve as airflow passageways. Clearly the airflow passageways may have virtually any shape and distribution, although rounded shapes and uniform distributions are preferred.

Figure 10:
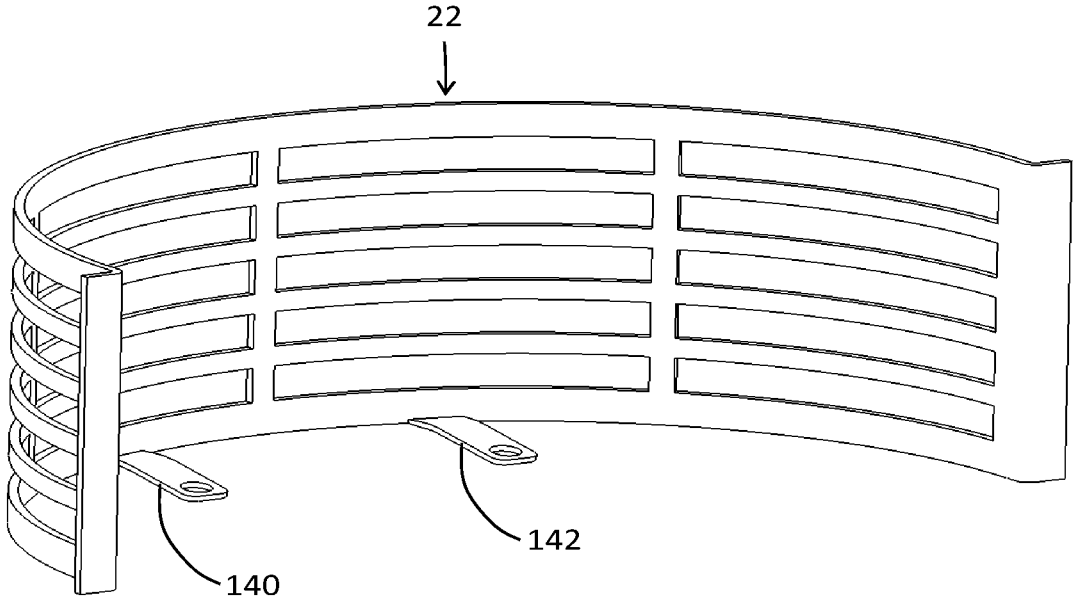
FIG. 10 is a perspective view of a modified vent support member in accordance with the present invention.
Figure 11:
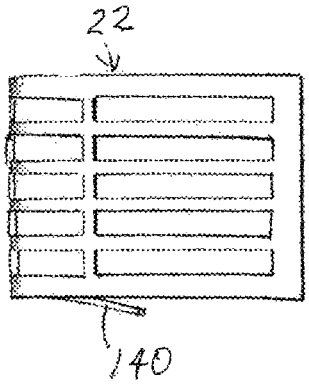
FIG. 11 is a side elevational view of the vent support member of FIG. 10.

As illustrated in FIGS. 10 and 11, a support (e.g., 22) as disclosed herein may be provided along a lower edge (e.g., 40) with tabs 140 and 142 to secure the assembled firepit vent assembly (e.g., 18) in place using fasteners. Tabs 140, 142 may be bent, formed, or welded such that they create spring tension in the vertical direction when the vent/intake assembly is placed within a firepit vent hole or airflow aperture (e.g., 44). This would help prevent movement of the vent/intake when installed without the use of fasteners. Going further, teeth (or additional protrusions) could even be added to the end of tabs 140, 142 to help grip into the surface even better. This feature could also be applied to the face plate 20, 20*a*-20*d* as well.

In carrying out a method for the safe use of a firepit 144 (FIGS. 5 and 6), one acquires a face plate 20, 20*a*-20*d*, or 120*a*-120*c* and a support member 22, 22*a*-22*e*. Firepit 144 has a containment wall 146 and the firepit vent through-hole or airflow aperture 44 in a lower portion of the wall. A compressive force is exerted on support member 22, 22*a*-22*e* to thereby press lateral ends or terminal portions 28 and 30 (FIGS. 1-6) of the support member towards one another, thereby reducing the separation between the terminal portions, and concomitantly flanges 38, 38*a*-38*e* from distance D1 to distance D2. While terminal portions 28 and 30 are disposed at the reduced distance D2 from one another owing to the pressing of the terminal portions towards one another, one inserts projections or flanges 38, 38*a*-38*e* of support member 22, 22*a*-22*e* to receiving formations 36, 36*a*-36*d* exemplarily defining slots, channels or receptacles e.g., 70, 82, 88, on face plate 20, 20-20*d*, 120*a*-120*c*. Thereafter the compressive force on the support member 22, 22*a*-22*e* is released to insert the projections, e.g., flanges 38, 38*a*-38*e*, into respective ones of the receiving formations 36, 36*a*-36*d* and thereby attach the face plate 20, 20-20*d*, 120*a*-120*c* and the support member 22, 22*a*-22*e* to one another to form an assembled and locked configuration of the face plate and the support member. The support member 22, 22*a*-22*e* has a predetermined resilience or elasticity effective to exert a spreading force on the support member to press the terminal portions 28 and 30 of the support member away from one another and lock the projections, e.g., flanges 38, 38*a*-38*e*, to the respective ones of the receiving formations. The method then entails manipulating the assembled configuration 18 to insert the support member 22, 22*a*-22*e* into the firepit vent through-hole or airflow aperture 44 in the firepit wall 146 and to dispose the face plate 20, 20-20*d*, 120*a*-120*c* approximately even with an outer surface (not designated) of the wall and at least approximately coextensive with the hole.

The manipulating of the assembled configuration 18 may more specifically include positioning the face plate 20, 20-20*d*, 120*a*-120*c* so that a peripheral portion thereof is in contact with the outer surface of the wall 146. Alternatively, the manipulating of the assembled configuration 18 includes positioning the face plate 20, 20-20*d*, 120*a*-120*c* so that the face plate is disposed within the firepit vent through-hole or airflow aperture 44 in the firepit wall 146 and even with the outer surface of the wall. Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What I claim is:

1. A vent assembly for an outdoor combustion facility, comprising:

a face member having a perimeter and a thickness in a direction orthogonal to said perimeter;

a support member having a predetermined resilience allowing limited elastic deformation of the support member upon application of manual compressive force to the support member, said support member having a first terminal portion along one end and a second terminal portion along an opposite end, wherein said first terminal portion and said second terminal portion are disposed at a first distance from one another in a relaxed or unstressed configuration of said support member;

first connectors provided on said face member proximate opposing ends thereof, said first connectors being spaced from one another along a length dimension of said face member; and second connectors provided on said support member at said first terminal portion and at said second terminal portion, wherein:

said second connectors are configured to cooperate with respective ones of said first connectors to attach said support member to said face member;

said predetermined resilience is effective to generate a spreading force within said support member to press said first terminal portion and said second terminal portion away from one another and lock said second connectors to said respective ones of said first connectors;

said first terminal portion and said second terminal portion being disposed at a second distance from one another in an assembled or locked configuration of said face member and said support member; and said second distance is less than said first distance.

2. The vent assembly defined in claim 1 wherein said support member has a lower edge, for contacting a horizontal support surface, said support member evincing, in the locked configuration of said face member and said support member, an at least partially arcuate profile in a horizontal cross-section taken parallel to said lower edge.

3. The vent assembly defined in claim 2 wherein said at least partially arcuate profile is concave on a side facing said face member in said assembled or locked configuration of said face member and said support member.

4. The vent assembly defined in claim 2 wherein said support member has one or more bends extending in a direction perpendicular to said lower edge.

5. The vent assembly defined in claim 1 wherein said first connectors and said second connectors are each taken from the group consisting of projections and receptacles.

6. The vent assembly defined in claim 5 wherein said projections take the form of flanges or ribs and said receptacles take the form of channels or slots.

7. The vent assembly defined in claim 1 wherein at least a portion of said perimeter has said thickness.

8. The vent assembly defined in claim 7 wherein said portion of said perimeter is linear and includes a linear edge.

9. The vent assembly defined in claim 1 wherein said perimeter is rectangular and said first terminal portion and said second terminal portion are linear.

10. The vent assembly defined in claim 1 wherein at least one of said face member and said support member has a perimeter broken or interrupted by indentations or recesses.

11. The vent assembly defined in claim 1 wherein said first connectors are taken from the group consisting of channels or slots and said second connectors are taken from the group consisting of flanges or ribs.

12. The vent assembly defined in claim 1 wherein said support member has one or more apertures between said first terminal portion and said second terminal portion.

13. The vent assembly defined in claim 1 wherein said face member has one or more apertures between said opposing ends.

14. A method for installing a vent assembly in a wall of an outdoor combustion facility, comprising:

providing a combustion space defined in part by a wall with at least one through-hole or recess in a lower portion of said wall;

providing a face plate;

providing a support member of elastically deformable material;

exerting a compressive force on said support member to thereby press end portions of said support member towards one another;

while said end portions are disposed at a reduced distance from one another owing to the pressing of said end portions towards one another, manipulating the support member to position projections on one of said face plate and said support member proximate respective receiving formations on the other of said face plate and said support member;

thereafter releasing the compressive force on said support member to lodge said projections in the proximate respective ones of said receiving formations and thereby attach said face member and said support member to one another to form an assembled configuration of said face member and said support member, said support member having a predetermined resilience or elasticity effective to exert a spreading force on said support member to press said end portions of said support member away from one another and lock said projections to said respective ones of said receiving formations; and manipulating said assembled configuration to dispose said support member in said through-hole or recess and dispose said face plate near an outer surface of said wall.

15. The method defined in claim 14 wherein the manipulating of said assembled configuration includes positioning said face plate so that a peripheral portion thereof is in contact with said outer surface of said wall.

16. The method defined in claim 14 wherein the manipulating of said assembled configuration includes positioning said face plate so that said face plate is disposed within said hole.

* * * * *